US011317714B2

(12) United States Patent
Gevrey

(10) Patent No.: US 11,317,714 B2
(45) Date of Patent: May 3, 2022

(54) ERGONOMIC STORAGE UNIT

(71) Applicant: ERGOMEUBLE, Condé-en-Normandie (FR)

(72) Inventor: Thierry Gevrey, Condé-en-Normandie (FR)

(73) Assignee: ERGOMEUBLE, Condé-en-Normandie (FR)

( * ) Notice: Subject to any disclaimer, the term of this patent is extended or adjusted under 35 U.S.C. 154(b) by 0 days.

(21) Appl. No.: 17/281,671

(22) PCT Filed: Oct. 2, 2019

(86) PCT No.: PCT/EP2019/076729
§ 371 (c)(1),
(2) Date: Mar. 31, 2021

(87) PCT Pub. No.: WO2020/070200
PCT Pub. Date: Apr. 9, 2020

(65) Prior Publication Data

US 2022/0000261 A1 Jan. 6, 2022

(30) Foreign Application Priority Data

Oct. 3, 2018 (FR) ..... 1859167

(51) Int. Cl.
*A47B 51/00* (2006.01)
*A47B 88/42* (2017.01)
(Continued)

(52) U.S. Cl.
CPC ..... *A47B 51/00* (2013.01); *A47B 67/04* (2013.01); *A47B 88/42* (2017.01); *A47B 88/457* (2017.01); *A47B 2210/0002* (2013.01)

(58) Field of Classification Search
CPC ..... A47B 51/00; A47B 67/04; A47B 88/457; A47B 2088/901
See application file for complete search history.

(56) References Cited

U.S. PATENT DOCUMENTS 6,484,893 B1 * 11/2002 Tkatch ..... A47B 46/00 211/103
8,424,983 B1 * 4/2013 Strauss ..... A47B 51/00 312/247
(Continued)

FOREIGN PATENT DOCUMENTS

DE 29701227 U1 4/1997
DE 102009016777 A1 11/2010
(Continued)

OTHER PUBLICATIONS

English translation of DE 29701227 from espacenet (Year: 2021).*
(Continued)

*Primary Examiner* — Daniel J Rohrhoff
(74) *Attorney, Agent, or Firm* — Tech Valley Patent, LLC; John Pietrangelo

(57) ABSTRACT

The invention concerns an ergonomic storage unit having at least one retractable container; and a mechanism configured to displace the at least one retractable container between two positions: a stowed position in which the retractable container is stowed in the storage unit; and an ergonomic position in which the retractable container is positioned in front of the storage unit and at a height which is different from that of the stowed position, in a manner such that the retractable container is more accessible as regards to height compared with the stowed position. The mechanism is configured to support the weight of the retractable container by distributing the weight on either side of the mechanism in the width direction of the retractable container, thereby establishing lateral access to the retractable container in the ergonomic position.

11 Claims, 10 Drawing Sheets

(51) Int. Cl.
*A47B 88/457* (2017.01)
*A47B 67/04* (2006.01)

(56) References Cited

U.S. PATENT DOCUMENTS

| | | | | |
|---|---|---|---|---|
| 2009/0289535 | A1* | 11/2009 | Weber | A47B 51/00 312/317.1 |
| 2018/0186569 | A1* | 7/2018 | Gevrey | A47B 51/00 |
| 2019/0150612 | A1* | 5/2019 | Parsons | B25H 3/021 |
| 2019/0380487 | A1* | 12/2019 | Sobolewski | E06B 3/5009 |

FOREIGN PATENT DOCUMENTS

| | | | |
|---|---|---|---|
| EP | 2526818 | A1 | 11/2012 |
| FR | 96126 | E | 5/1972 |
| JP | HO231520 | U | 2/1990 |

OTHER PUBLICATIONS

International Search Report from parent PCT application PCT/EP2019/076729, 3 pages.
Written Opinion from parent PCT application PCT/EP2019/076729, 6 pages.

* cited by examiner

ERGONOMIC STORAGE UNIT

CROSS-REFERENCE TO RELATED APPLICATIONS

This application is a § 371 filing of PCT application PCT/EP2019/076729 filed on Oct. 2, 2019, which claims priority from French application FR 1859167 filed on Oct. 3, 2018, the disclosures of these applications are included by reference herein in their entirety.

BACKGROUND

Field of the Invention

The present invention relates to a unit that permits anybody to access the entire contents of this unit in an ergonomic manner without using elevating accessories.

More precisely, the invention relates to a unit wherein each of the containers can be pulled out from said unit and mechanically brought to a height allowing a user to gain easy access to the entirety of its contents.

Prior Art

Patent application WO2017/005991 A1 from the Applicant presents an ergonomic storage device intended to be installed over the entire height of a room or a piece of furniture, in order to use all of the available space.

That device contains several drawers which can be pulled out from the structure of said device by means of a mechanism comprising at least one hoist which can be moved over the depth of said device, said movable hoist being located laterally with respect to the drawers.

That device can be used to pull each of the drawers out via their sides, and to bring them to a height which differs from that of their storage height. In doing this, said device can be used to improve access to the containers which are normally difficult or impossible for a user who does not have an elevating means (chair, stepladder, hoist, etc) to reach.

Since the mechanism is located at the side of the drawer, the user can more easily access the drawers via their width. This feature in fact limits the useful depth of the drawers and necessitates the production of a device with a large container width.

In addition, a single movable hoist cannot support large loads. When said device comprises just one movable hoist on one side of the drawers, it then has an overhung loading. In this case, the admissible load in each of the drawers is reduced so that the mechanism is not compromised.

The technical problem which the invention proposes to solve is to provide an ergonomic storage unit which provides a user with easy access to the entirety of its contents.

DISCLOSURE OF THE INVENTION

The present invention proposes to solve this technical problem by means of an ergonomic storage unit comprising a mechanism designed to bring at least one retractable container into a position that allows a user easy access to the entirety of its contents, without any limitations to depth or to admissible load, by distributing the volume of said retractable container either side of said mechanism.

To this end, the invention concerns an ergonomic storage unit comprising:

at least one retractable container; and a mechanism configured in order to displace said at least one retractable container between two positions:

- a stowed position in which said retractable container is stowed in said storage unit; and
- an ergonomic position in which said retractable container is positioned in front of said storage unit and at a height which is different from that of the stowed position, in a manner such that the retractable container comes into a position which is more accessible as regards height compared with the stowed position.

The invention is characterized in that said mechanism is configured in order to support the weight of said retractable container by distributing it either side of said mechanism in the width direction of said retractable container, therefore establishing lateral access to said retractable container in the ergonomic position.

The invention therefore proposes a novel type of ergonomic unit in which said at least one retractable container is distributed either side of said mechanism. A first advantage of the invention over the prior art is that the load is balanced either side of a single mechanism. A second advantage of the invention is to allow the user to access the retractable container via their sides and their width, therefore overcoming depth limitations.

In accordance with one embodiment of the invention, said retractable container is a storage box, which can in turn be sub-divided into several distinct storage spaces. As an example, this retractable container may be a cabinet or a support which is specifically designed to accommodate products such as bottles, test tubes, tools, etc.

In this manner, it is possible to bring large quantities of contents into an ergonomic position; this was not possible in the prior art.

For this embodiment of the invention, said mechanism corresponds to an arm fixed on the one hand to a fixed plane of said storage unit and on the other hand to said box, and comprising:

- a first element composed of two profiles: a first profile which is fixed with respect to said storage unit, and a second profile which is mounted to slide on said first profile in the depth direction of said storage unit; and
- a second element composed of two other profiles: a first profile which is fixed with respect to said box and a second profile which is mounted to slide on said first profile in the height direction of said storage unit;
- one end of said first profile of said second element being secured to one end of said second profile of said first element.

As an example, said mechanism is located at the rear of the box, thereby leaving the user free to access this box via its width and via its sides. This constitutes an advantage with respect to the prior art, in which the retractable containers are only accessible via their width and possibly via one of their sides.

In accordance with another embodiment of the invention, said mechanism comprises:

- a hoist which is movable in the depth direction of said unit; and
- a shuttle mounted on said hoist and movable in the height direction of said hoist, said shuttle comprising means for securing to said at least one retractable container.

This mechanism can be used to grasp and displace said at least one retractable container into stowed and ergonomic positions. This mechanism is different from the prior art in that the weight of said retractable container, when it is secured to the shuttle, is distributed either side of the hoist, in effect dispensing with any overhang actions on said mechanism.

Advantageously; said at least one retractable container comprises at least one notch which is capable of cooperating with said securing means in a manner such as to secure said retractable container to said shuttle.

Advantageously, the displacements of said hoist, the displacement of said shuttle and the displacements of said securing means are motorised.

The securing means can advantageously be used to allow the shuttle: to be secured to said at least one movable container selected by the user with the aim of bringing it from the stowed position into the ergonomic position.

Advantageously, said at least one retractable container is composed of two drawers located either side of said hoist and secured by their backs.

Advantageously, said mechanism comprises a counterweight, said counterweight comprising:

a rail on which a weight slides; and a top pulley disposed above the maximum height of said at least one retractable container;

and a belt connected to the shuttle and to the weight, in a manner such as to counterbalance the mass of said retractable container during the course of its vertical displacement.

In a variation, said at least one retractable container is composed of two drawers located either side of said hoist (31), said two drawers being independent of each other, and said securing means (34) for said shuttle (32) being configured either to pull said two drawers out simultaneously, or to pull out one of the two drawers.

In accordance with the invention, this latter embodiment means that two drawers can be pulled out, but application may advantageously be adapted when said at least one movable container is very deep and intended to carry only a small weight, as may be the case with storage units in pharmacies.

BRIEF DESCRIPTION OF THE FIGURES

The manner of carrying out the invention as well as the advantages thereof will become apparent from the following embodiments given by way of non-limiting indication and with the aid of the accompanying drawings, in which

FIG. 1: a perspective view of an ergonomic storage unit in accordance with a first embodiment of the invention, wherein said at least one retractable container corresponds to a storage box, said storage box being shown in the stowed position;

FIG. 2: a perspective view of the ergonomic storage unit of FIG. 1, said storage box being shown in an intermediate position between the stowed position and the ergonomic position;

FIG. 3: a perspective view of the ergonomic storage unit of FIG. 1, said storage box being shown in the ergonomic position;

FIG. 4: a lateral sectional view of the ergonomic storage unit of FIG. 1, said storage box being shown in the ergonomic position;

FIG. 5: a perspective view of an ergonomic storage unit in accordance with a second embodiment of the invention, said at least one retractable container being shown in the stowed position;

FIG. 6: a perspective view of the ergonomic storage unit of FIG. 5, said at least one retractable container being shown in an intermediate position between the stowed position and the ergonomic position;

FIG. 7: a perspective view of the ergonomic storage unit of FIG. 5, said at least one retractable container being shown in the ergonomic position;

FIG. 8: a perspective view of the retractable container of FIG. 5;

FIG. 9: a perspective view of the retaining elements for the retractable container of FIG. 5; and FIG. 10: a perspective view of the displacement mechanism for the retractable container of FIG. 5 in the ergonomic position.

DETAILED DESCRIPTION OF THE INVENTION

The invention concerns an ergonomic storage unit 1*a*, 1*b*, containing at least one retractable container 100, 101, displaced between two positions by a mechanism 11, 30: a stowed position and an ergonomic position.

In the remainder of the description, the ergonomic storage unit 1*a*, 1*b* will be described with reference to its height H, its depth P and its width L.

Figure 1:
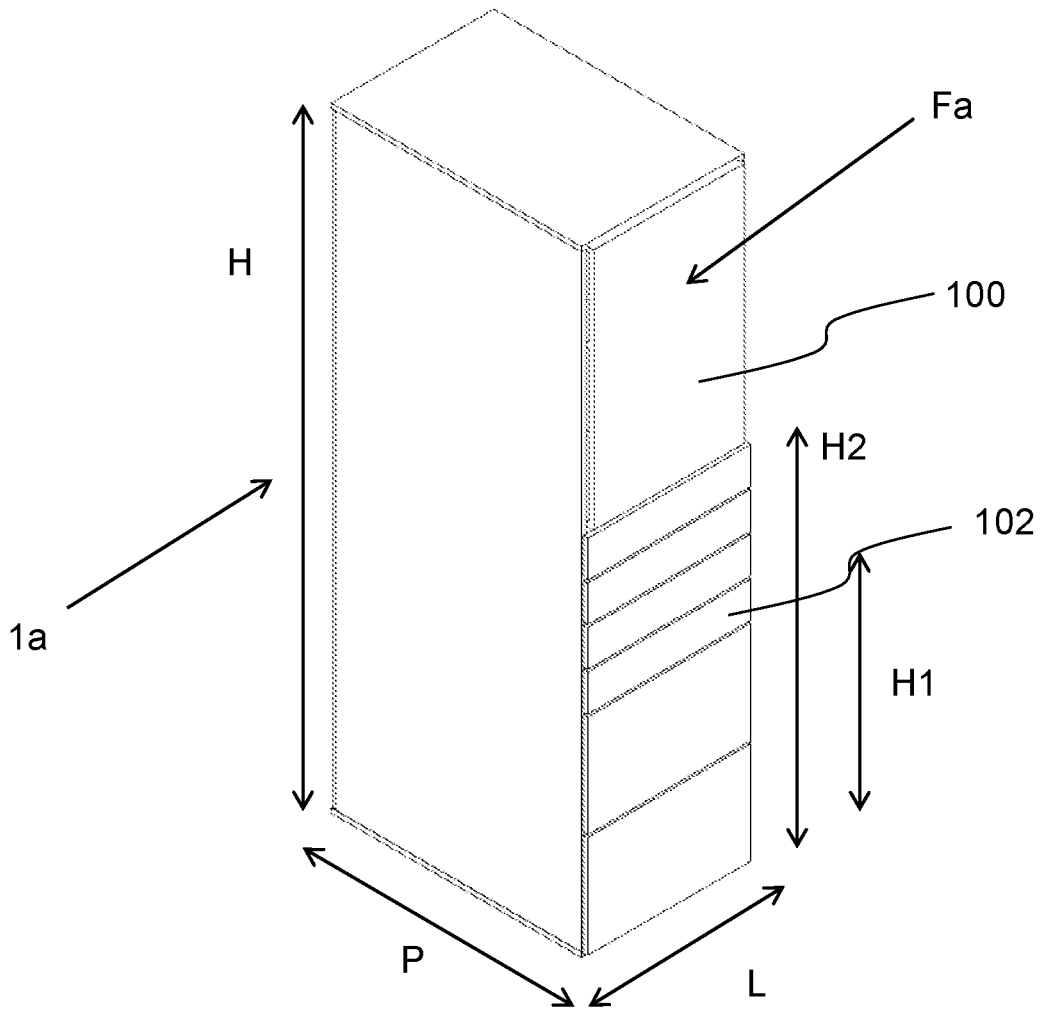
FIGS. 1 to 10 represent.
Figure 3:
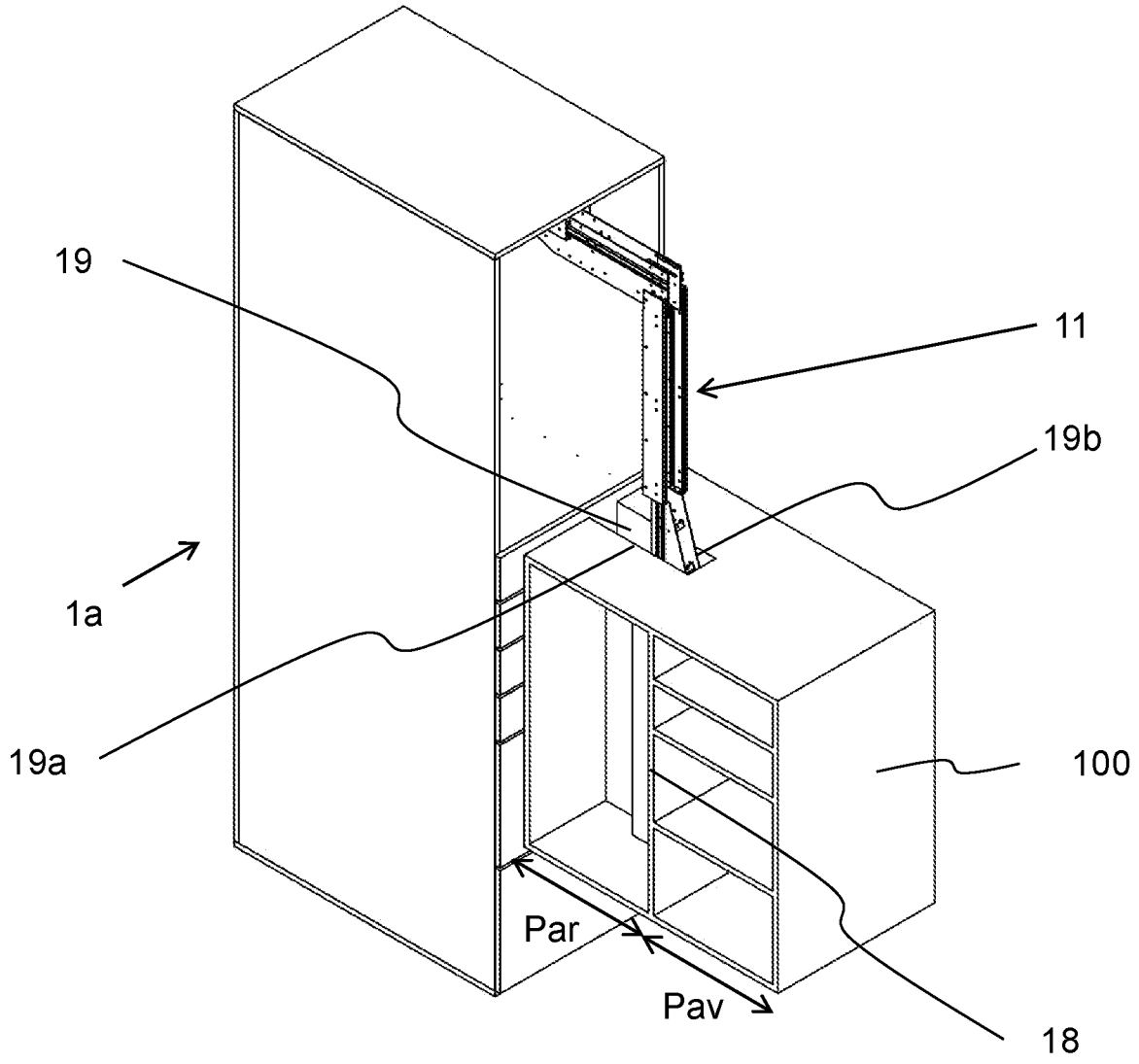
Figure 5:
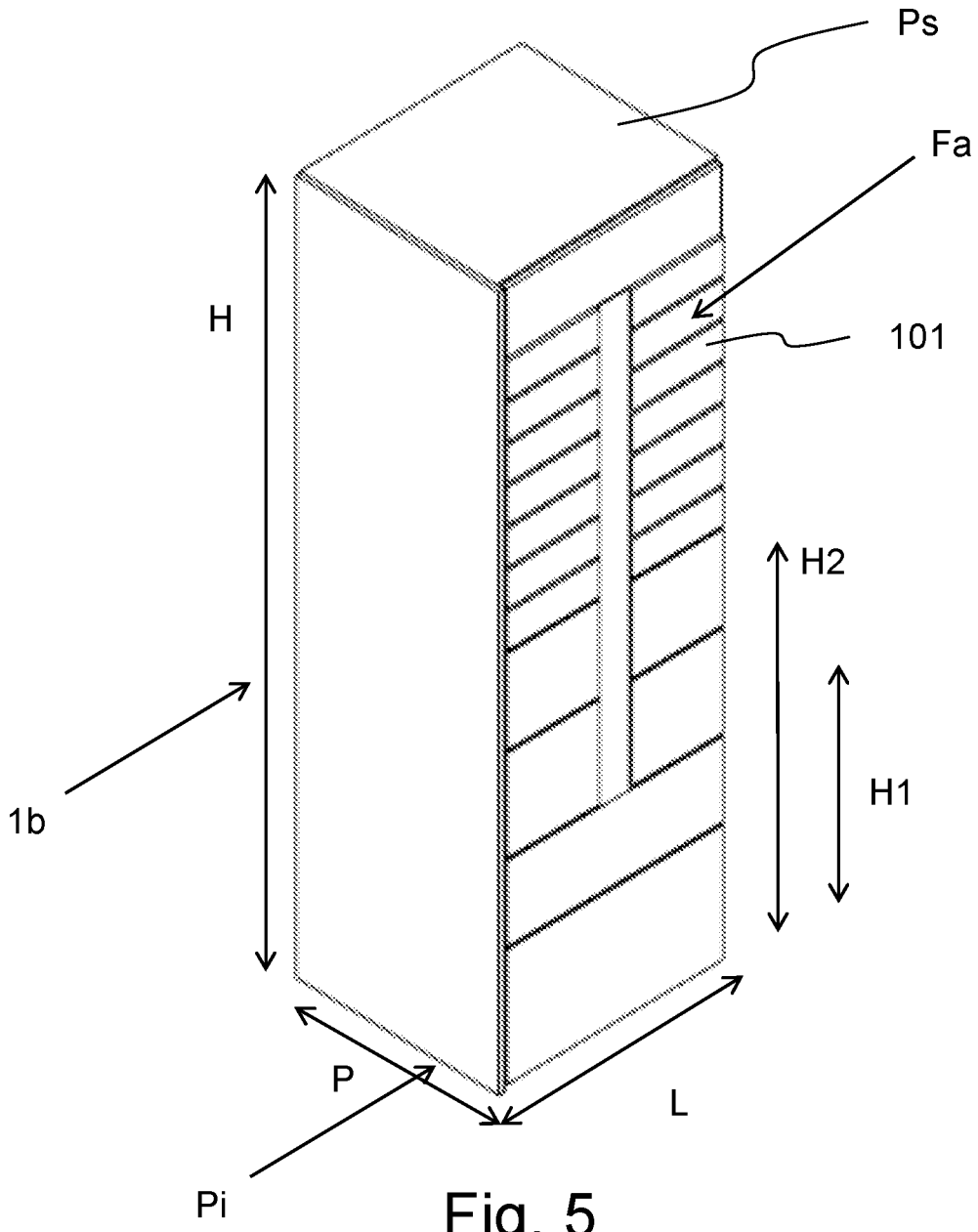
Figure 7:
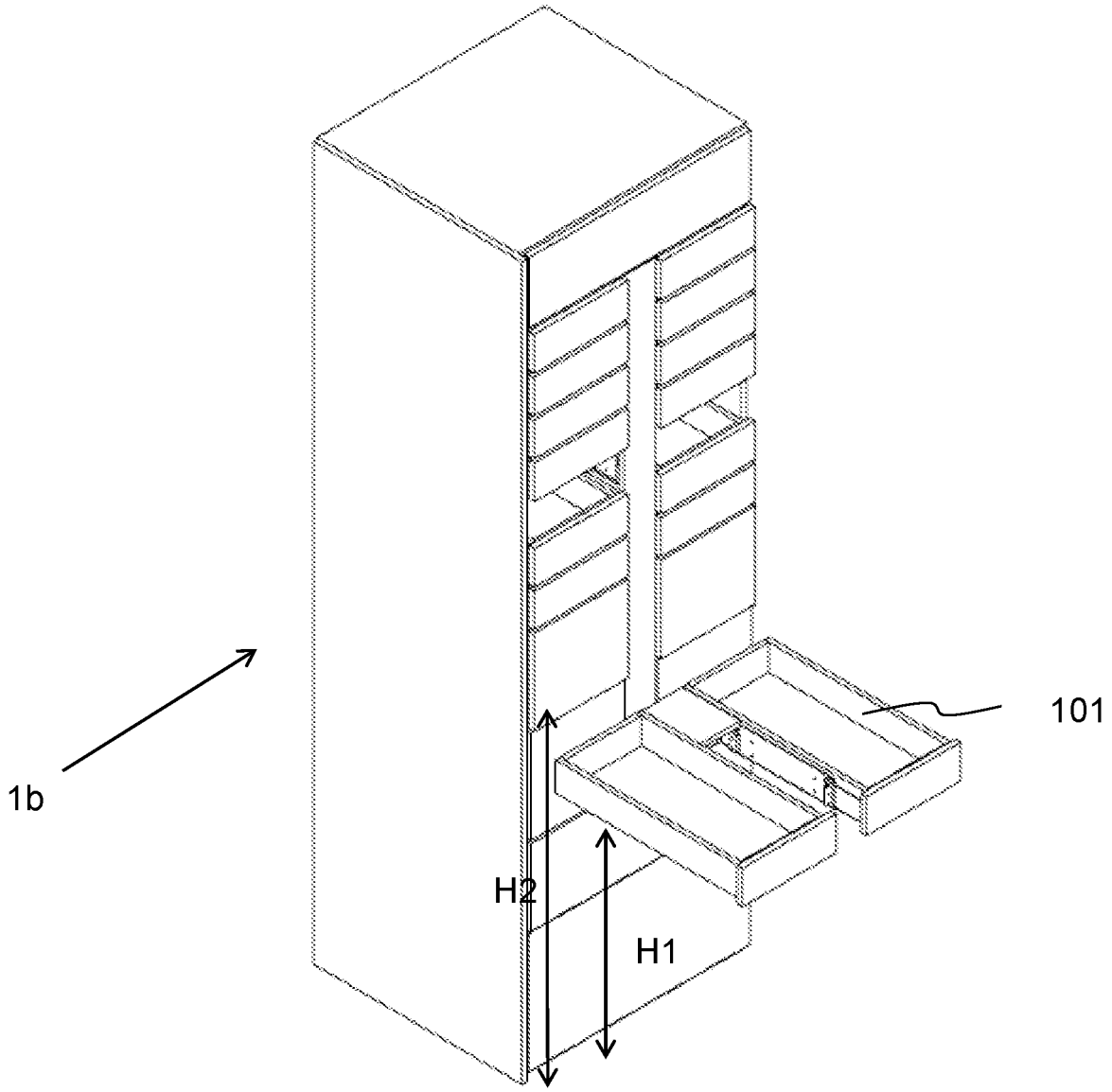

When the retractable container 100, 101 is in the stowed position, as illustrated in FIGS. 1 and 5, it is completely integrated into the depth P of said storage unit 1*a*, 1*b*. When this retractable container 100, 101 is in the ergonomic position, as illustrated in FIGS. 3 and 7, it is positioned in front of the storage unit 1*a*, 1*b* at a height which is preferably in the range 800 to 900 mm. At this specific height, a user can easily access the contents of the retractable container 100, 101, even if the user has a disability or mobility problems, for example when the user is a wheelchair user.

Thus, between the stowed position and the ergonomic position, the retractable container 100, 101 is firstly displaced in the depth P direction of the storage unit 1*a*, 1*b* in a manner such that the entire volume of the retractable container 100, 101 goes beyond the front face Fa of the storage unit 1*a*, 1*b*. Next, the retractable container 100, 101 is displaced in the height H direction of the storage unit 1*a*, 1*b* in a manner such as to reach the desired ergonomic height, for example between 800 and 900 mm.

During this second displacement, the retractable container 100, 101 may be displaced upwardly when the retractable container 100, 101 has previously been disposed below the ergonomic height. In contrast, the retractable container 100, 101 may be displaced downwardly when the retractable container 100, 101 has previously been disposed above the ergonomic height.

The mechanism 11, 30 may be configured so that the containers disposed at the level of the ergonomic height cannot be pulled out. The user can then use these containers in a conventional manner; as an example, the containers may correspond to drawers mounted on runners fixed to the lateral walls of the storage unit 1*a*, 1*b*.

FIG. 1 illustrates an embodiment of the invention in which the ergonomic storage unit 1*a* comprises four superimposed drawers 102 at an ergonomic height and mounted on runners fixed to the lateral walls of the storage unit 1*a*.

The ergonomic height extends between the heights 111 and 112 of the storage unit 1*a* between which the user can readily access the drawers.

Above the height 112, the storage unit 1*a* comprises a retractable container corresponding to a storage box 100 extending over the entire depth P and width L available between the walls of the ergonomic storage unit 1*a*.

Figure 2:
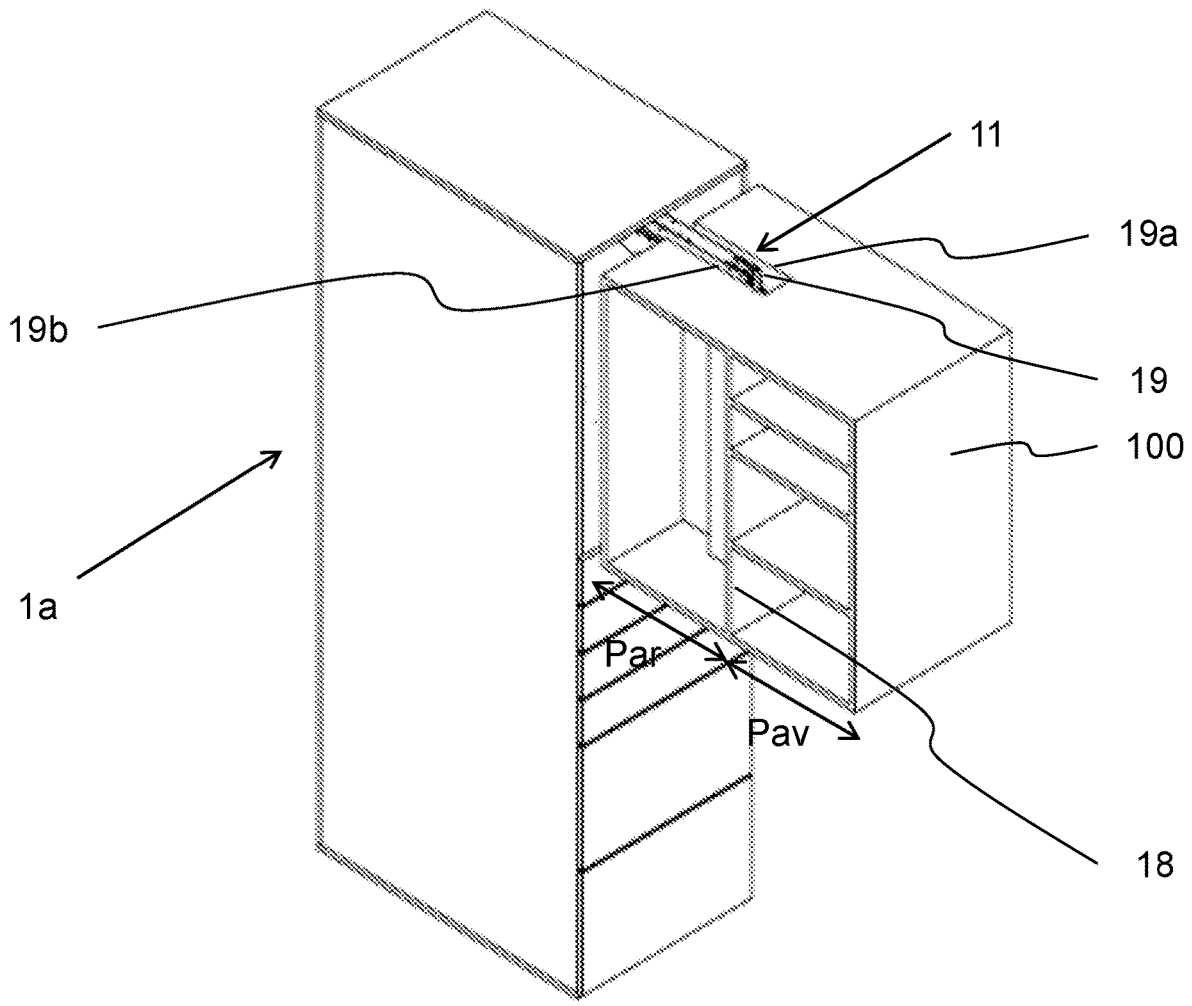

The storage box 100 is movable between two positions: a stowed position shown in FIG. 1, in which said storage box 100 is stowed inside said storage unit 1*a*, and an ergonomic position shown in FIG. 3, in which said storage box 100 is located at the front of said storage unit 1*a* and at the ergonomic height. FIG. 2 in turn illustrates an intermediate position between the stowed position (FIG. 1) and ergonomic position (FIG. 3).

In order to displace the storage box 100 between the stowed and ergonomic positions, this embodiment proposes the use of a mechanism forming an arm 11 supporting the weight of said storage box 100.

Figure 4:
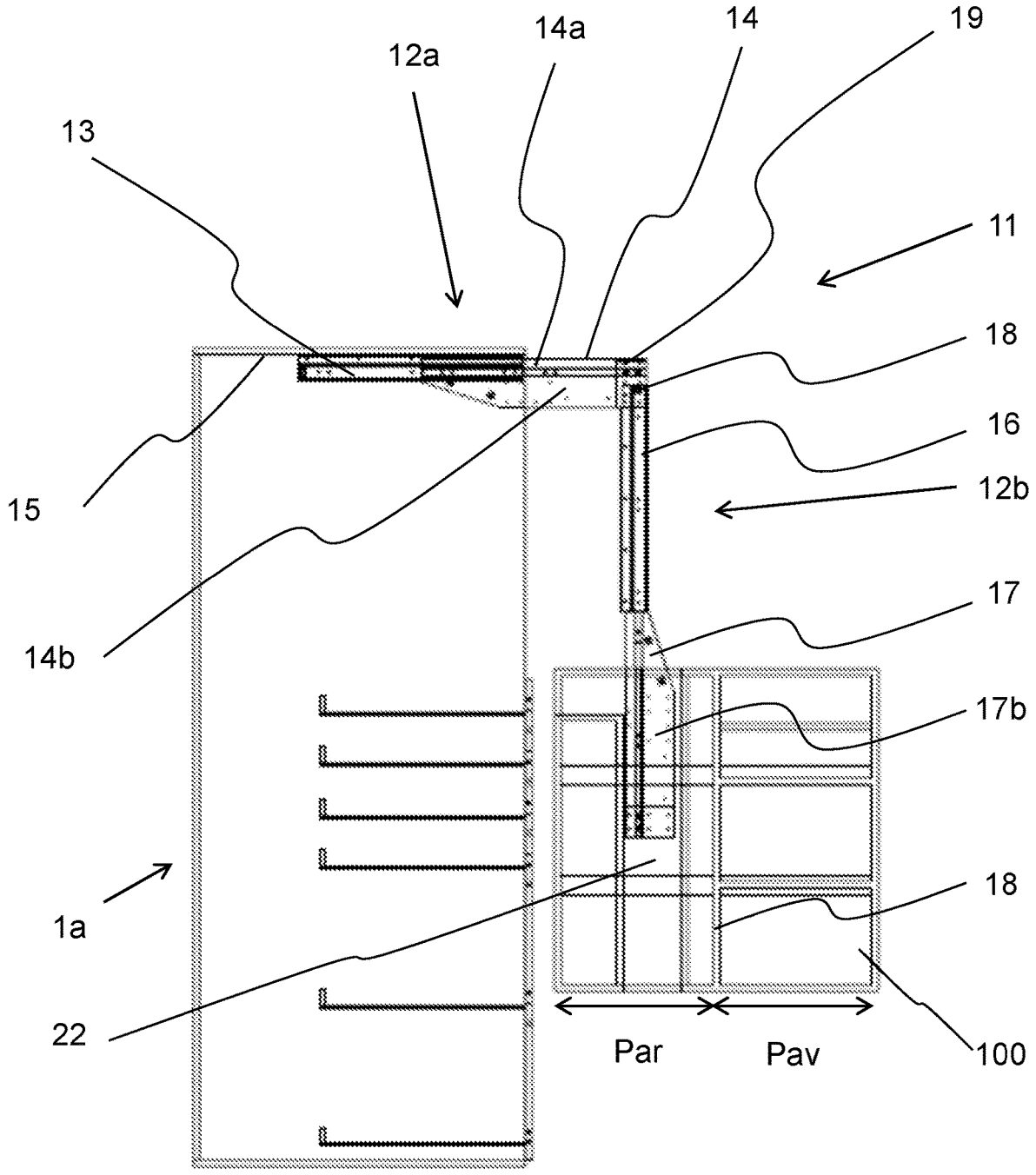

As illustrated in FIG. 4, the arm 11 is constituted by two elements:

- a first element 12*a* constituted by two rectilinear profiles 13 and 14; and
- a second element 12*b*, also constituted by two rectilinear profiles 16 and 17.

The first profile 13 of the first element 12*a* is in the form of a rail wherein the bottom of the groove is fixed to a fixed plane 15 of the storage unit 1*a*. More precisely, as illustrated in FIG. 4, the rail is fixed to the upper wall 15 of the storage unit 1*a* via bolts or rivets. In a variation, the storage unit 1*a* may be open at its upper end towards the ceiling of a room and the rail may be fixed directly to this ceiling.

The second profile 14 of the first element 12*a* comprises an upper portion 14*a* which is shaped in order to provide the displacements of the second profile 14 in the rail of the first profile 13. To this end, the second profile 14 comprises, for example, wheels or a ball bearing runner. Below this upper portion 14*a*, the second profile 14 comprises a lower portion 14*b* fixed to the upper portion 14*a* and intended to provide the support for the storage box 100.

This lower portion 14*b* is, for example, in the form of a plate extending in the direction towards the bottom of the storage unit 1*a*.

A front end 19 of this plate 14*b* is fixed to an upper end 18 of the first profile 16 of the second element 12*b*. This first profile 16 is in the form of a rail, the upper end 18 of which is fixed to the plate 14*b* via bolts or rivets. This first profile 16 extends perpendicularly to the length of the plate 14*b*, i.e. in the height H direction of the storage unit 1*a*.

A second profile 17 of the second element 12*b*, substantially corresponding to the shape of the second profile 14 of the first element 12*a*, is mounted in the rail of the first profile 16 in a manner such as to displace the storage box 100 in the height H direction of the storage unit 1*a*. To this end, a plate 17*b* of the second profile 17 is fixed to a rear portion of the storage box 100.

In fact, the storage box 100 is divided into two portions: a front portion Pay, used for storage, and a rear portion Par, intended to support the storage box 100 and also being provided with several storage units located either side of said box. The front portion Pay has four levels subdivided by shelves up to a central partition 18. Behind the central partition 18, the storage box 100 comprises a groove 19 extending in the height direction of the storage box 100 from a rear face to the central partition 18. The plate 17*b* of the second profile 17 is fixed to partitions 19*a* and 19*b* mounted either side of the groove 19. Thus, the plate 17*b* may be secured with a plurality of bolts or a plurality of rivets disposed over the entire height of the storage box 100 in order to provide a secure connection between the arm 11 and the storage box 100.

The disposition of the connection between the arm 11 and the storage box 100 also means that said arm 11 can be placed in the immediate vicinity of the centre of gravity of said storage box 100. This particular disposition has the advantage of limiting the turning moment generated by the distance between the centre of gravity of said storage box 100 and said arm 11.

Thus, the forces applied to the second element 12*b* are essentially tensile forces, which limits the risk of premature wear or deformation of the parts forming the arm 11.

In order to ensure a secure connection between the different parts of the arm 11, the two elements 12*a* and 12*b* are preferably produced from metallic materials the cross section of which is adapted to the weight of the storage box 100 and its maximum load.

The displacements of the two elements 12*a*, 12*b* bring about the displacements of the storage box 100. These displacements may be provided mechanically in a simple manner with a linkage actuated by the user. Preferably, these displacements are motorised with geared motors coupled to each element 12*a* and 12*b* and controlled by a box disposed within reach of the user at the ergonomic height, or remotely controlled. As an example, the motors may control the displacement of gear wheels mounted on the second profiles 14 and 17 and cooperating with racks provided in the rails of the first profiles 13 and 16. In a variation, the displacement of the elements 12*a* and 12*b* may be carried out using hydraulic cylinders. Furthermore, the element 12*a* may be fixed to a bottom wall of the storage unit 1*a* by using a hydraulic cylinder to displace the first element 12*a* in the depth P direction.

In the example of FIGS. 1 to 4, the storage box 100 is disposed above the ergonomic height in the stowed position. In a variation, a retractable storage box may also be provided below the ergonomic height H1 by using a second element 12*b* configured to raise the storage box 100 between the stowed position and the ergonomic position.

In another example, the containers disposed below the ergonomic height H1 may correspond to an elevator intended to adjust the height of the unit, and thus the ergonomic height, as a function of the size of the user. The containers disposed below the ergonomic height H1 may also be drawn back in order to allow access in the depth direction of the unit below the ergonomic height H1, for example in order to facilitate access for a wheelchair user's legs or for the bonnet of a car when the unit is installed in a garage.

FIG. 5 illustrates another embodiment of the invention, in accordance with which said storage unit 1*b* comprises several retractable containers 101 formed by superimposed drawers 37, 38 connected in pairs. In the same manner as in the preceding embodiment, said at least one retractable container 101 is configured so as to be displaced between the stowed position and the ergonomic position by a mechanism 30.

Figure 8:
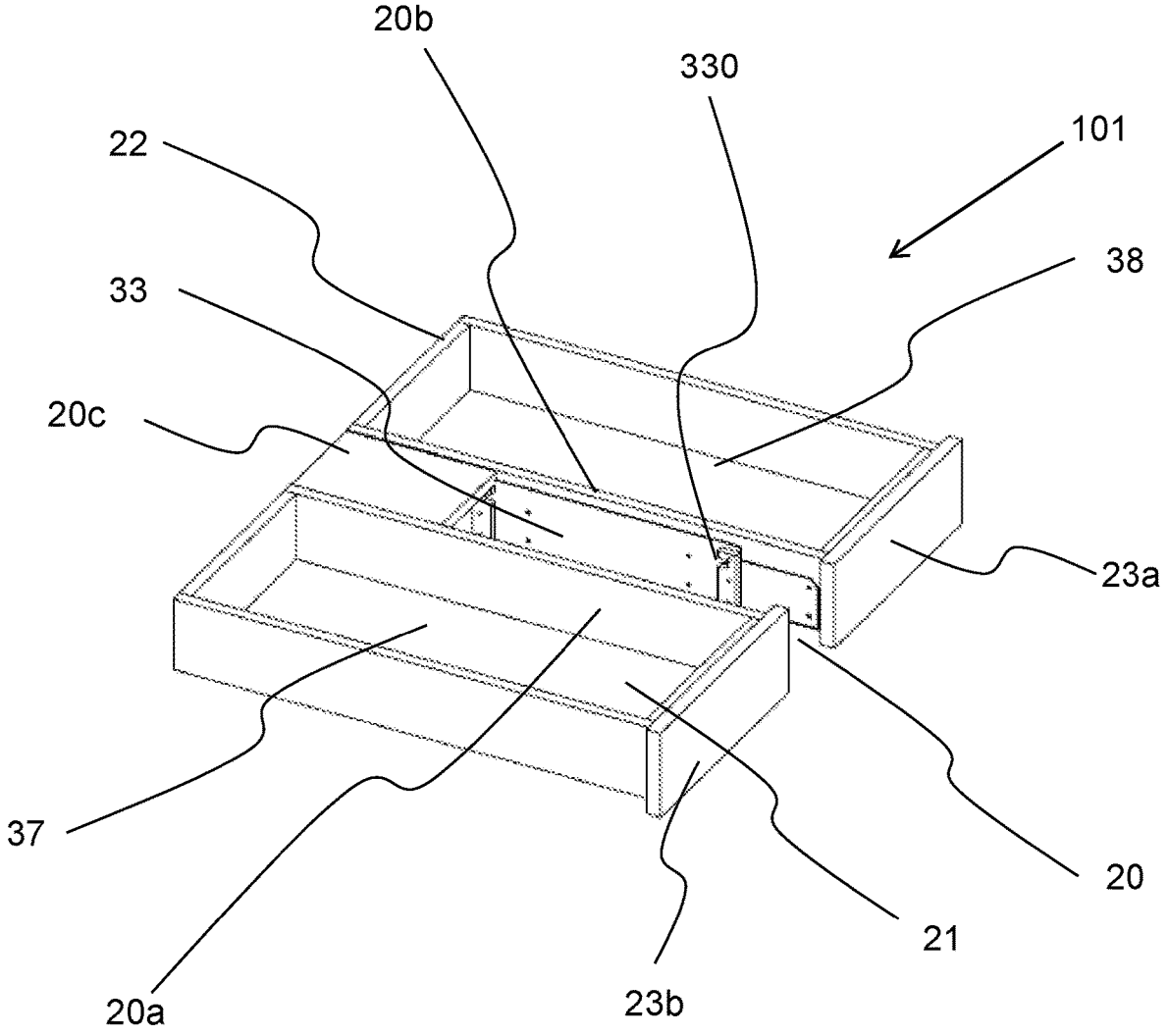

The retractable container 101, as illustrated in FIG. 8 is constituted by a bottom 21 intended to accommodate the contents of said retractable container 101. A groove 20 extends in the retractable container 101 from the front face Fa in the direction of the depth P of said storage unit 1*b*. This groove 20 separates said retractable container 101 into two distinct drawers 37 and 38, distributed either side of said groove 20.

The retractable container 101 is delimited at the rear by the partition 22, at the same time delimiting the volumes of the drawers 37 and 38. The retractable container 101 thus has two front partitions 23*a* and 23, on the front face Fa of the storage unit 1*b*. Preferably, the drawers 37 and 38 have identical volumes; in fact, in this particular case, the front partitions 23*a* and 23*b* will have the same dimensions.

Furthermore, the compartments 37 and 38 are closed by two parallel partitions 20*a* and 20*b* positioned facing each other, either side of said groove 20. The drawers 37 and 38 are secured together by means of a panel 20*c* which is parallelepipedal in shape and extends in the length of said groove 20, wherein two parallel sides are fixed to said two partitions 20*a* and 20*b*.

A plate 33 is fixed by means of screws or rivets to said two partitions 20*a* and 20*b*, in a manner such that said plates are located facing each other inside said groove 20.

Each plate 33 comprises at least one notch 330. Preferably, the plate 33 is produced from a metallic material.

Figure 6:
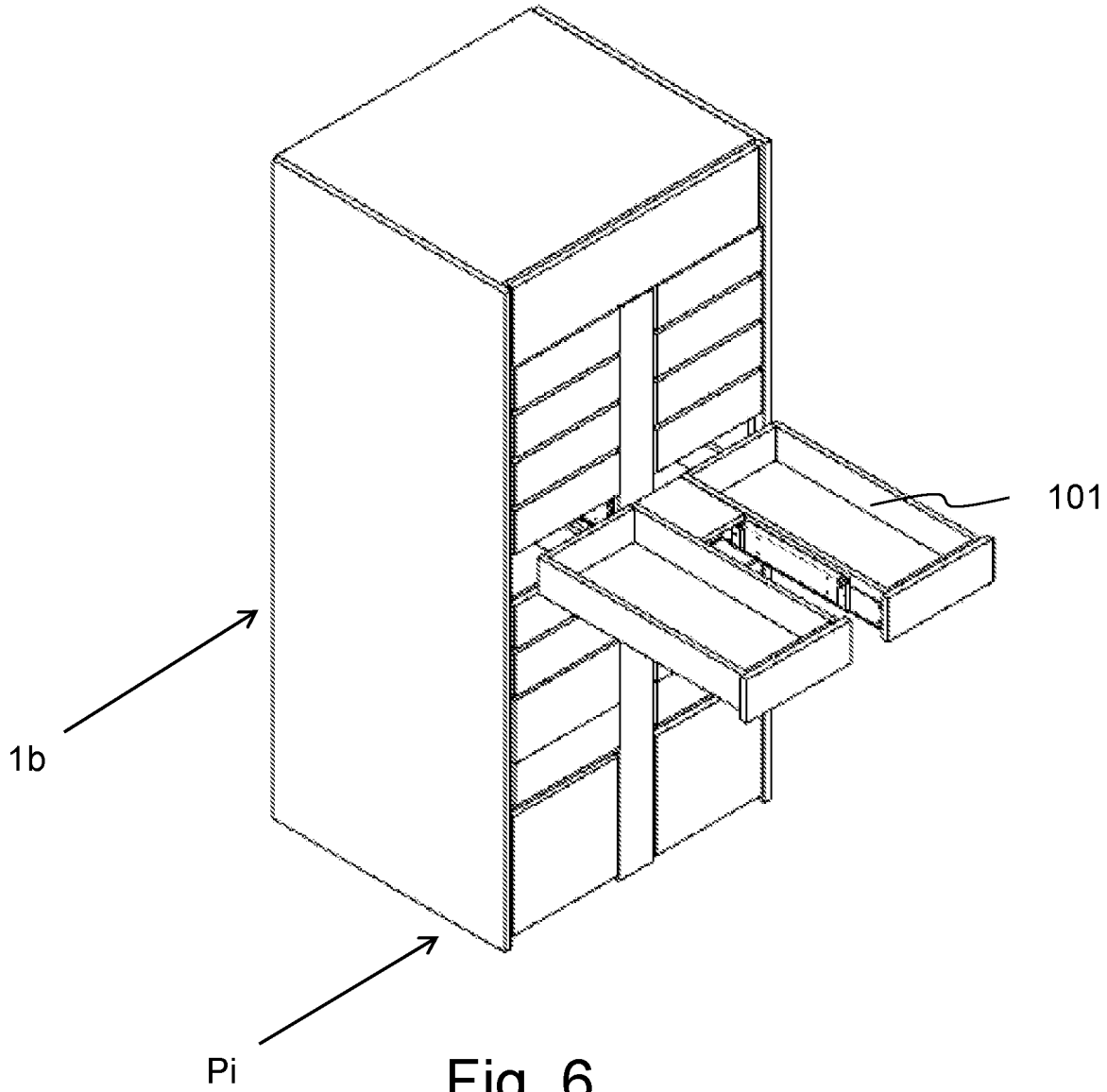

Said at least one retractable container 101 is movable between two positions: the stowed position shown in FIG. 5 and the ergonomic position shown in FIG. 7. FIG. 6 in turn illustrates the retractable container 101 in the intermediate position.

Figure 9:
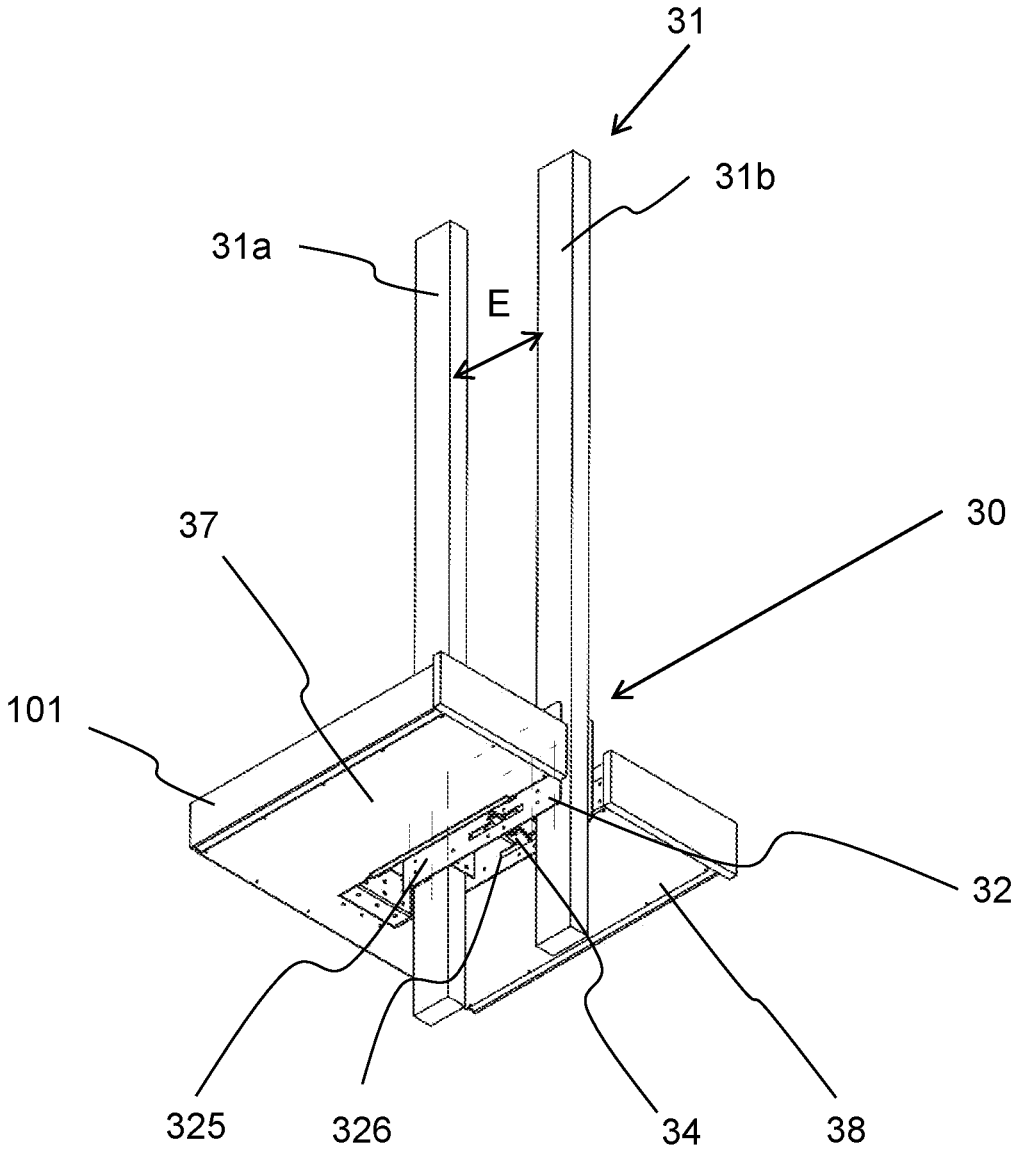
Figure 10:
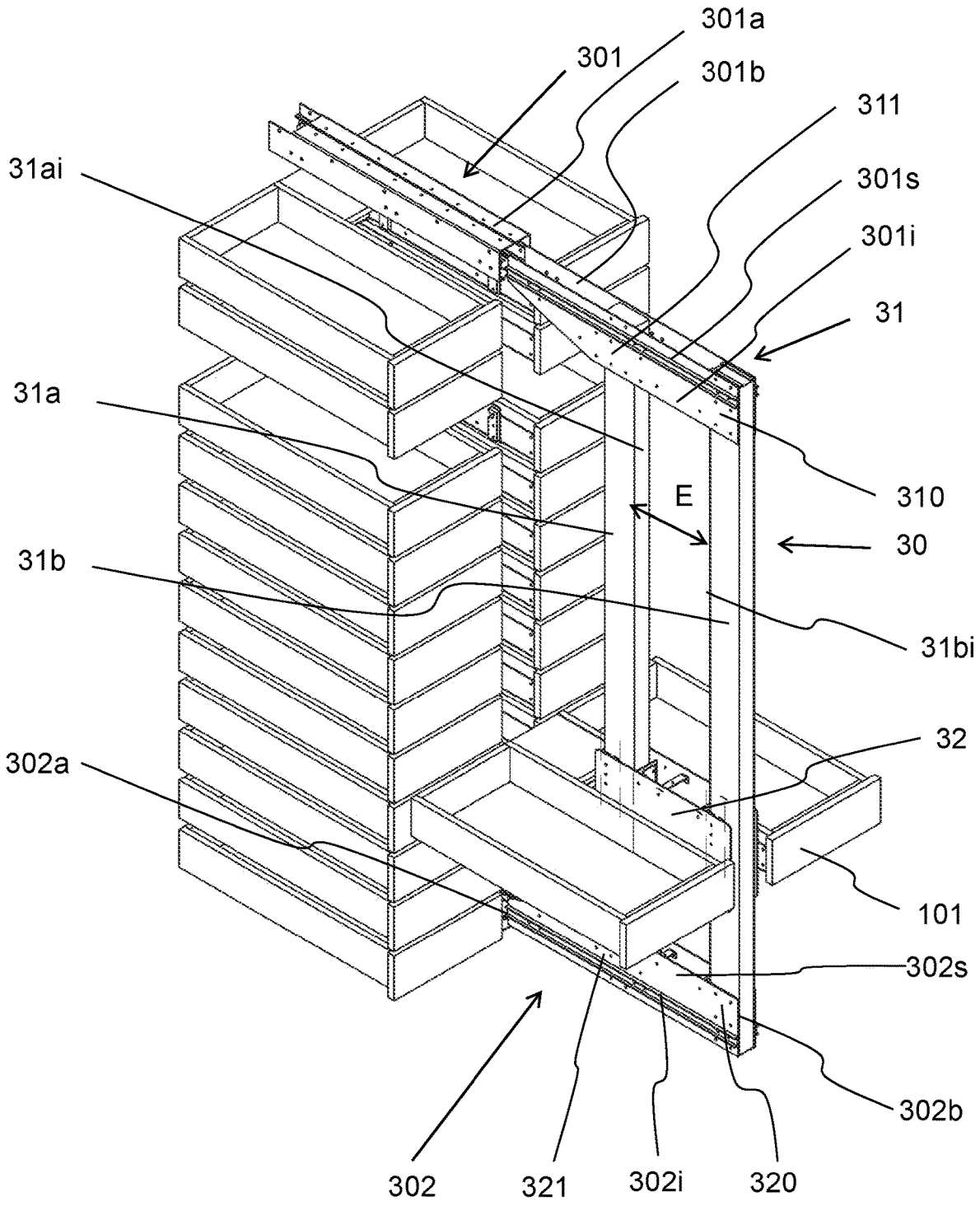

The displacements in the height H direction and the depth P direction of said retractable container 101 are carried out by means of the mechanism 30. As illustrated in FIGS. 9 and 10, said mechanism 30 is composed of several sub-assemblies:

a hoist 31; and an upper hoist support 301; and a lower hoist support 302; and a shuttle 32.

Preferably, the hoist 31 is composed of two vertical uprights, a front upright 31*a*, and a rear upright 31*b*. These two uprights 31*a*, 31*b* are parallel, and constituted by a profile with an identical section, preferably parallelepipedal. Said uprights 31*a*, 31*b* extend in the height H direction of said storage unit, between a lower wall Pi and an upper wall Ps, said lower walls Pi and upper wall Ps being illustrated in FIG. 5.

In a variation, in order to limit the weight and the parallel stresses between said uprights 31*a*, 31*b*, the hoist 31 may be constituted by a single vertical upright extending in the height H direction of said storage unit between a lower wall Pi and an upper wall Ps, said lower walls Pi and upper walls Ps being illustrated in FIG. 5.

As illustrated in FIGS. 9 and 10, the uprights 31*a*, 31*b* are mounted facing each other, in the same plane, in the depth P direction of said storage unit 1*b*. They are separated by a distance E.

Said hoist 31 is secured to said storage unit 1*b* by a system of two hoist supports 301 and 302.

The upper hoist support 301 is mounted in the direction of the depth P of said storage unit, and is constituted by two elements:

a fixed element 301*a*; and a movable element 301*b*.

The fixed element 301*a* of said upper hoist support 301 is in the form of a rail wherein the groove is fixed to a fixed plane 15 of the storage unit 1*b*. More precisely, the rail is fixed to the upper wall 15 of the storage unit 1*b* via bolts or rivets. In a variation, the storage unit 1*b* may be open at its upper end towards the ceiling of a room and the rail may be fixed directly to this ceiling.

Said movable element 301*b* of said upper hoist support 301 comprises an upper portion 301*s* shaped in order to provide the displacements of said movable element 301*b* in the rail of said fixed element 301*a*. To this end, said movable element 301*b* comprises wheels or a ball bearing runner, for example. Below this upper portion 301*s*, said movable element 301*b* comprises a lower portion 301*i* fixed to the upper portion 301*s* and intended to provide the support for said hoist 31.

This lower portion 301*i* is, for example, in the form of a plate extending in the direction towards the bottom of the storage unit 1*b*. A front end 310 of this plate is fixed to an upper end of the front upright 31*a* of said hoist 31. A rear end 311 of this plate is fixed to an upper end of the rear upright 31*b* of said hoist 31.

Preferably, the lower portion 301*i* and said uprights 31*a* and 31*b* are secured by clinching, welding or by using added elements such as bolts or rivets.

In the same manner, the lower hoist support 302 is mounted in the direction of the depth P of said storage unit, and is constituted by two elements:

a fixed element 302*a*; and a movable element 302*b*.

The fixed element 302*a* of said lower hoist support 302 is in the form of a rail, wherein the groove is fixed to the lower wall Pi of the storage unit 1*b*. More precisely, the rail is fixed to the lower wall Pi of the storage unit 1*b* via bolts or rivets. In a variation, the storage unit 1*b* may be open at its lower end towards the floor of a room and the rail may be fixed directly to this floor.

Said movable element 302*b* of said lower hoist support 302 comprises a lower portion 302*i* which is shaped in order to establish the displacements of said movable element 302*b* in the rail of the first element 302*a*. To this end, said movable element 302*b* comprises wheels or a ball bearing runner, for example. On this lower portion 302*i*, said movable element 302*b* comprises an upper portion 302*s* fixed to the lower portion 302*i* and intended to provide the support for said hoist 31.

This upper portion 302*s* is, for example, in the form of a plate extending in the direction towards the top of the storage unit 1*b*. A front end 320 of this plate is fixed to a lower end of the first vertical upright 31*a* of said hoist 31. A rear end 321 of this plate is fixed to a lower end of the second vertical upright 31*b* of said hoist 31.

Preferably, the fixing elements between the upper portion 302*s* and said uprights 31*a* and 31*b* are bolts or rivets.

In this configuration, the system constituted by said hoist supports 301, 302 therefore allow the hoist 31 to be displaced in the depth P direction of said storage unit 1*b*.

The displacements of the hoist 31 may manually actuated by the user with the aid of a linkage system. Preferably, these displacements are motorised with geared motors coupled to each element 301*b* and 302*b* and controlled by a box disposed within reach of the user at the ergonomic height, or remotely controlled. As an example, the motors may control the displacement of gear wheels mounted on the movable elements 301*b* and 302*b*, and cooperating with racks provided in the rails of the fixed elements 301*a* and 302*a*. In a variation, the displacement of the hoist supports 301 and 302 may be carried out using hydraulic cylinders.

As illustrated in FIG. 9, the shuttle 32 is constituted by two plates 325, 326, these two plates being symmetrical with respect to the plane of said hoist 31, and are mounted either side of said hoist 31. The length of each plate 325, 326 extends from the rear end of said first upright 31*a* to the front end of said second upright 31*b*. Preferably, the height of each plate 325, 326 is equal to or greater than the height of said retractable container 101.

In the space between the two plates 325, 326 is a securing means 34, fixed to said plates 325, 326 by means of rivets or screws.

Said securing means 34 cooperates with said notches 330 to fix said shuttle 32 to said retractable container 101. Preferably, said securing means 34 comprises a lug which can move on the surface of each plate 325, 326. This movable lug is retractable into the space E, and its shape is complementary to that of said notches 330.

Said movable lug can be manoeuvred by the user with a linkage system, or is preferably moved by a geared motor controlled by the control box of said storage unit 1*b*.

Advantageously, in accordance with another embodiment, which is not shown, the plate 33 may comprise two lugs fixed perpendicular to said plate 33 and capable of being connected to a system of hooks. Facing each fixed lug, this system of hooks comprises a hook located between the plate 33 and the movable shuttle 32. Said hook is rotatably mounted on an axis parallel to said at least one fixed lug and is capable of being fixed to said at least one fixed lug under the control of the user. Said hook may be controlled either manually by the user by means of a mechanical linkage system or, as is preferable, via a geared motor located between the two plates 325, 326 and controlled by said control box of said storage unit 1*b*.

In a variation, said system of hooks may be replaced by a system of sliding latches comprising, facing each lug fixed between the plate 33 and the movable shuttle 32, a fork provided with a central groove directed in the depth P direction. In order to secure said shuttle to said retractable container 101, said fork is displaced in the depth P direction of said unit 1*b* in order to surround said fixed lug. Each fork is actuated by a cam connected to a pinion which is rotated by a geared motor incorporated into said shuttle 32 inside the space E. Advantageously, said geared motor is controlled by said control box of said storage unit 1*b*.

On the other hand, in the space E, the shuttle 32 contains displacement means such as at least one caster or a slide, not shown, configured in order to roll on the inner faces 31*a*1 and 32*bi* of said vertical uprights 31*a* and 31*b*. Preferably, the inner faces 31*a*1 and 32*bi* are in the form of racks cooperating with said at least one caster.

The vertical displacements of said shuttle 32 on said hoist 31 are controlled by the user via a mechanical linkage system. Preferably, these displacements are motorised with geared motors coupled to casters R and controlled by the box disposed within reach of the user at the ergonomic height, or remotely controlled. In a variation, these displacements may be carried out using hydraulic cylinders.

As commanded by the user, the shuttle 32 is positioned facing said retractable container 101 and is connected to it by means of the securing means 34. The hoist 31 is then translated in the direction of the depth P to the front of said storage unit 1*b*, then said shuttle 32 is displaced to the ergonomic height 111, in a manner such as to present said retractable container 101 at a position which is comfortable for the user.

FIG. 10 represents a view of a retractable container 101 connected to the shuttle 32, and positioned in the ergonomic position.

Advantageously, in accordance with another embodiment, not shown, said ergonomic storage unit 1*a*, 1*b* also comprises a counterweight comprising a rail on which a counterweight slides, a top pulley disposed above the maximum height of said at least one retractable container, and a belt connected to the shuttle 32 and to the counterweight, in a manner such as to counterbalance the weight of said storage box 100 or said retractable container 101 as it is displaced in the height H direction. This counterweight system can advantageously be used to limit, on the one hand, the energy consumption necessary to displace said shuttle 32, and on the other hand to increase the useful load capacities in each retractable container 101.

In the example of FIGS. 5 to 10, said retractable container 101 is composed of two drawers 37, 38 located either side of said hoist 31 and secured via their backs 22.

In a variation, said two drawers 37 and 38 of said retractable container 101 are independent of each other. In this case, said shuttle comprises two securing means 340 and 341 which are symmetrical with respect to the plane of the hoist, and fixed to the shuttle in the space E. These two securing means 340 and 341 enable the user to connect the assembly of said two drawers 37 and 38 to the shuttle or alternatively, one of the two. Thus, the user may elect to pull out the assembly of the two drawers 37 and 38 to the ergonomic position, or to pull out only one of them.

The invention thus concerns an ergonomic storage unit comprising a mechanism designed to bring at least one retractable container into an ergonomic position, without limitation to either the depth or the admissible load, by distributing the volume of said retractable container either side of said mechanism.

The invention claimed is:

1. An ergonomic storage unit comprising:
- at least one storage box; and
- a mechanism configured to displace the at least one storage box between two positions:
  - a stowed position in which the at least one storage box is stowed in the storage unit; and
  - an ergonomic position in which the at least one storage box is positioned in front of the storage unit and at a height different from the stowed position, wherein the at least one storage box is more accessible than when positioned in the stowed position;
- wherein the mechanism comprises:
  - a hoist movable in a depth direction of the storage unit by an upper hoist support and a lower hoist support;
  - a shuttle mounted on the hoist, the shuttle movable in a height direction of the hoist, the shuttle comprising means for securing the shuttle to the at least one storage box; and
  - an arm fixed on a fixed plane of the storage unit and fixed on the at least one storage box, the arm comprising:
    - a first element comprising two profiles: a first profile fixed to the storage unit and a second profile slidably mounted on the first profile in the depth direction of the storage unit; and
    - a second element comprising two profiles: a first profile fixed to the at least one storage box, and a second profile slidably mounted on the first profile in the height direction of the storage unit;
    - wherein one end of the first profile of the second element is secured to one end of the second profile of the first element;
- wherein the mechanism is configured to support a weight of the at least one storage box by distributing the weight on either side of the mechanism in a width direction of the at least one storage box, thereby establishing lateral access to the at least one storage box in the ergonomic position.

2. The ergonomic storage unit as claimed in claim 1, wherein the at least one storage box comprises at least one notch cooperating with the means for securing to secure the at least one storage box to the shuttle.

3. The ergonomic storage unit as claimed in claim 2, wherein displacement of the hoist, displacement of the shuttle and displacement of the means for securing are motorized.

4. The ergonomic storage unit as claimed in claim 1, wherein the at least one storage box comprises two drawers located on either side of the hoist.

5. The ergonomic storage unit as claimed in claim 4, wherein each of the two drawers is secured by the means for securing the shuttle to the at least one storage box to a back of each of the two drawers.

6. The ergonomic storage unit as claimed in claim 1, wherein the at least one storage box comprises two drawers located on either side of the hoist, the two drawers being independent of each other, wherein the means for securing the shuttle is configured to extract either the two drawers simultaneously or one of the two drawers.

7. The ergonomic storage unit as claimed in claim 1, wherein the mechanism further comprises a counterweight device, the counterweight device comprising:

a rail on which a weight slides; and a top pulley disposed above a maximum height of the at least one storage box; and a belt connected to the shuttle and to the weight, wherein a mass of the weight counterbalances a mass of the at least one storage box during vertical displacement of the at least one storage box.

8. An ergonomic storage unit comprising:

at least one retractable container; and a mechanism configured to displace the at least one retractable container between two positions:

a stowed position in which the retractable container is stowed in the storage unit; and an ergonomic position in which the at least one retractable container is positioned in front of the storage unit and at a height different from the stowed position, wherein the at least one retractable container is more accessible than when positioned in the stowed position;

wherein the mechanism comprises:

a hoist movable in a depth direction of the storage unit by an upper hoist support and a lower hoist support; and a shuttle mounted on the hoist, the shuttle movable in a height direction of the hoist, the shuttle comprising means for securing the shuttle to the at least one retractable container;

wherein the mechanism is configured to support a weight of the at least one retractable container by distributing the weight on either side of the mechanism in a width direction of the at least one retractable container, thereby establishing lateral access to the at least one retractable container in the ergonomic position; and wherein the at least one retractable container comprises two drawers located on either side of the hoist.

9. The ergonomic storage unit as claimed in claim 8, wherein each of the two drawers is secured by the means for securing the shuttle to the at least one retractable container to a back of each of the two drawers.

10. An ergonomic storage unit comprising:

at least one retractable container; and a mechanism configured to displace the at least one retractable container between two positions:

a stowed position in which the retractable container is stowed in the storage unit; and an ergonomic position in which the at least one retractable container is positioned in front of the storage unit and at a height different from the stowed position, wherein the at least one retractable container is more accessible than when positioned in the stowed position;

wherein the mechanism comprises:

a hoist movable in a depth direction of the storage unit by an upper hoist support and a lower hoist support; and a shuttle mounted on the hoist, the shuttle movable in a height direction of the hoist, the shuttle comprising means for securing the shuttle to the at least one retractable container;

wherein the mechanism is configured to support a weight of the at least one retractable container by distributing the weight on either side of the mechanism in a width direction of the at least one retractable container, thereby establishing lateral access to the at least one retractable container in the ergonomic position; and wherein the at least one retractable container comprises two drawers located on either side of the hoist, the two drawers being independent of each other, wherein the means for securing the shuttle is configured to extract either the two drawers simultaneously or one of the two drawers.

11. An ergonomic storage unit comprising:

at least one retractable container; and a mechanism configured to displace the at least one retractable container between two positions:

a stowed position in which the retractable container is stowed in the storage unit; and an ergonomic position in which the at least one retractable container is positioned in front of the storage unit and at a height different from the stowed position, wherein the at least one retractable container is more accessible than when positioned in the stowed position;

wherein the mechanism comprises:

a hoist movable in a depth direction of the storage unit by an upper hoist support and a lower hoist support;

a shuttle mounted on the hoist, the shuttle movable in a height direction of the hoist, the shuttle comprising means for securing the shuttle to the at least one retractable container; and a counterweight device, the counterweight device comprising:

a rail on which a weight slides; and a top pulley disposed above a maximum height of the at least one retractable container; and a belt connected to the shuttle and to the weight, wherein a mass of the weight counterbalances a mass of the at least one retractable container during vertical displacement of the at least one retractable container;

wherein the mechanism is configured to support a weight of the at least one retractable container by distributing the weight on either side of the mechanism in a width direction of the at least one retractable container, thereby establishing lateral access to the at least one retractable container in the ergonomic position.

* * * * *